US005228421A

United States Patent [19]

Orzel

[11] Patent Number: 5,228,421

[45] Date of Patent: Jul. 20, 1993

[54] IDLE SPEED CONTROL SYSTEM

[75] Inventor: Daniel V. Orzel, Westland, Mich.

[73] Assignee: Ford Motor Company, Dearborn, Mich.

[21] Appl. No.: 967,343

[22] Filed: Oct. 28, 1992

[51] Int. Cl.[5] ..... F02M 3/00

[52] U.S. Cl. ..... 123/339; 123/518; 123/520

[58] Field of Search ..... 123/339, 680, 520, 518, 123/519, 344, 406

[56] References Cited

U.S. PATENT DOCUMENTS

| | | | |
|---|---|---|---|
| 4,047,507 | 9/1977 | Naguchi et al. | 123/344 |
| 4,467,769 | 8/1984 | Matsumura | 123/434 |
| 4,619,232 | 10/1986 | Morris | 123/352 |
| 4,641,623 | 2/1987 | Hamburg | 123/518 |
| 4,715,340 | 12/1987 | Cook et al. | 123/406 |
| 4,715,340 | 12/1987 | Cook et al. | 123/406 |
| 4,741,318 | 5/1988 | Kortge et al. | 123/520 |
| 4,748,959 | 1/1988 | Cook et al. | 123/520 |
| 4,967,713 | 11/1990 | Kojima | 123/680 |
| 4,974,444 | 12/1990 | Neubacher | 73/118.1 |
| 5,041,976 | 8/1991 | Marko et al. | 364/424.03 |
| 5,048,492 | 9/1991 | Davenport et al. | 123/339 |
| 5,048,493 | 9/1991 | Orzel et al. | 123/434 |
| 5,083,541 | 1/1992 | Chen | 123/339 |
| 5,090,388 | 2/1992 | Hamburg et al. | 123/339 |

*Primary Examiner*—Raymond A. Nelli

*Attorney, Agent, or Firm*—Allan J. Lippa; Roger L. May

[57] ABSTRACT

An idle speed control system includes a bypass throttling device coupled in parallel with the primary engine throttle. At the beginning of each idle speed control period, a controller generates an initial bypass throttle position from a desired or reference engine speed. Correction of this initial position is provided based upon a learned error between initial bypass throttle position and the actual position which is maintained by feedback control. The learning routine is enabled in response to an indication that the quantity of inducted fuel vapors is below a minimum value.

11 Claims, 7 Drawing Sheets

IDLE SPEED CONTROL SYSTEM

BACKGROUND OF THE INVENTION

The field of the invention relates to idle speed control systems for motor vehicles having fuel vapor recovery systems coupled between the fuel system and engine air/fuel intake.

Idle speed control systems are known for controlling a bypass throttling device connected in parallel with the primary engine throttle. During engine idling, when the primary throttle is closed, the bypass throttle is first turned to an initial position calculated from desired idling speed and thereafter controlled by conventional feedback.

It is also known to correct for errors between the initial throttle position and the throttle position required to maintain, on average, the desired engine speed. In such adaptive systems, the initial positioning error may be learned from the feedback variable (i.e., difference between desired and actual engine speed). Thereafter, the initial throttle position is corrected by the learned error to reduce such initial positioning error.

The inventor herein has recognized several problems when conventional idle speed control systems are deployed in motor vehicles having a fuel vapor recovery system. When inducting purged air through the fuel vapor recovery system during engine idle, the bypass throttle will be reduced so that the total inducted airflow will maintain desired engine speed. The adaptive system will then learn and apply the reduced throttle position as the initial position during a subsequent idle operation. If intervening engine operation, such as cruising down a highway, recovers all the stored fuel vapors, the subsequent return to engine idle will occur without fuel vapor purging. Application of the previously learned initial throttle position may then result in engine stumble or stall.

SUMMARY OF THE INVENTION

An object of the invention herein is to provide an idle speed control system which operates effectively on motor vehicles having fuel vapor recovery systems.

The above object is achieved, and problems of prior approaches overcome, by providing an idle speed control system and control method for motor vehicles having fuel vapor recovery systems coupled between the vehicle's fuel system and engine air/fuel intake. In one particular aspect of the invention, the control method comprises the steps of: initiating idle speed control during each period when engine operating parameters remain in a predetermined state; calculating a desired engine speed upon the initiation of the idle speed control period; generating an initial throttle position for a throttling device bypassing a primary engine throttle valve, the initial bypass throttle position being based upon the desired engine speed; correcting the initial bypass throttle position upon the initiation of the idle speed control period by a correction factor calculated by comparing the desired engine speed to actual engine speed during a previous idle speed control period; and learning a new correction factor during current idle speed control operation for application during a subsequent idle speed control period, the learning being enabled when an indication is provided that quantity of recovered fuel vapors inducted into the engine is less than a preselected value.

An advantage of the above aspect of the invention is that learning a correction factor for the initial throttle position is inhibited during fuel vapor recovery such that erroneous correction during subsequent idling operation is avoided.

BRIEF DESCRIPTION OF THE DRAWINGS

The object and advantages of the invention claimed herein and others will be more clearly understood by reading an example of an embodiment in which the invention is used to advantage with reference to the attached drawings wherein:

DESCRIPTION OF AN EMBODIMENT

Figure 1:
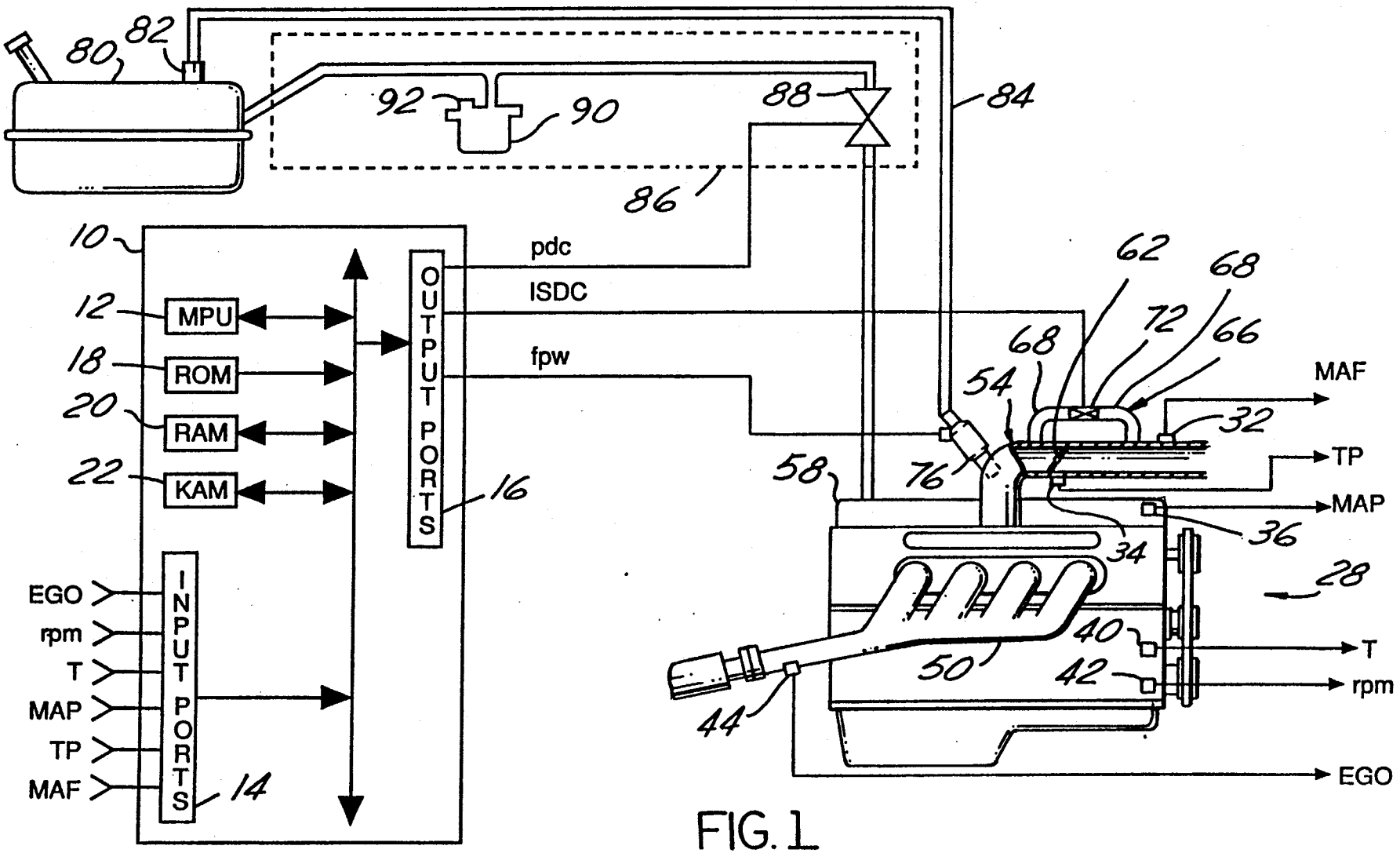
FIG. 1 is a block diagram of an embodiment wherein the invention is used to advantage.

Controller 10 is shown in the block diagram of FIG. 1 as a conventional microcomputer including: microprocessor unit 12; input ports 14; output ports 16; read only memory 18, for storing control programs; random access memory 20, for temporary data storage which may also be used for counters or timers; keep-alive memory 22, for storing learned values; and a conventional data bus. As described in greater detail later herein with particular reference to FIGS. 2–7, controller 10 controls operation of engine 28 by the following control signals: pulse width signal fpw for controlling liquid fuel delivery; purge duty cycle signal pdc for controlling fuel vapor recovery; and idle speed duty cycle signal ISDC for controlling engine idle speed.

Controller 10 is shown receiving various signals from conventional engine sensors coupled to engine 28 including: measurement of inducted mass airflow (MAF) from mass airflow sensor 32; indication of primary throttle position (TP) from throttle position sensor 34; manifold absolute pressure (MAP), commonly used as an indication of engine load, from pressure sensor 36; engine coolant temperature (T) from temperature sensor 40; indication of engine speed (rpm) from tachometer 42; output signal EGO from exhaust gas oxygen sensor 44 which, in this particular example, provides an indication of whether exhaust gases are either rich or lean of stoichiometric combustion.

In this particular example, engine 28 is shown having EGO sensor 44 coupled to exhaust manifold 50 upstream of conventional catalytic converter 52 (not shown). Intake manifold 58 of engine 28 is shown coupled to throttle body 54 having primary throttle plate 62 positioned therein. Bypass throttling device 66 is shown coupled to throttle body 54 and includes: bypass conduit 68 connected for bypassing throttle 62; and solenoid valve 72 for throttling conduit 68 in proportion to the duty cycle of idle speed duty cycle signal ISDC from controller 10.

Throttle body 54 is also shown having fuel injector 76 coupled thereto for delivering liquid fuel in proportion to the pulse width of signal fpw from controller 10. Fuel is delivered to fuel injector 76 by a conventional fuel system including fuel tank 80, fuel pump 82, and fuel rail 84.

Fuel vapor recovery system 86 is shown including vapor storage canister 90 connected in parallel to fuel tank 80 for absorbing fuel vapors therefrom by activated charcoal contained within the canister. Fuel vapor recovery system 86 is shown connected to intake manifold 58 via electronically actuated purge control valve 88. In this particular example, the cross-sectional area of purge control valve 88 is determined by the duty cycle of actuating signal pdc from controller 10.

During fuel vapor recovery, commonly referred to as vapor purge, air is drawn through canister 90 via inlet vent 92 thereby desorbing hydrocarbons from the activated charcoal. The mixture of purged air and recovered fuel vapors is inducted into manifold 58 via purge control valve 88. Concurrently, recovered fuel vapors from fuel tank 80 are drawn into intake manifold 58 through valve 88.

Figure 2:
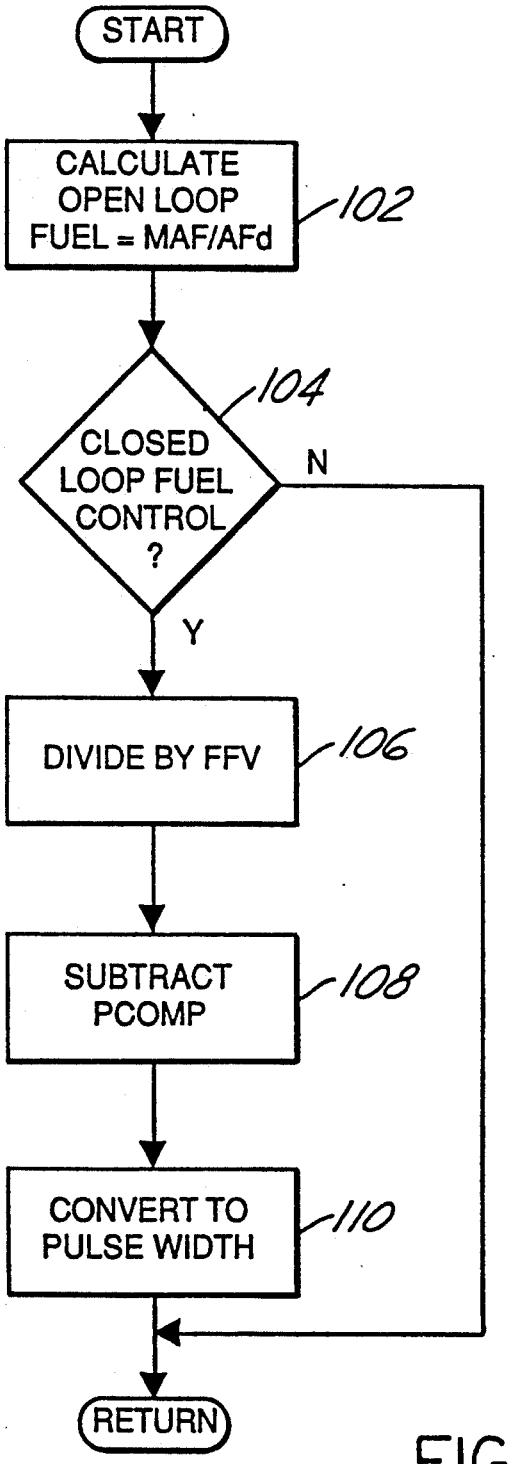
FIGS. 2–7 are high level flowcharts illustrating steps performed by a portion of the embodiment illustrated in FIG. 1.

Referring now to FIG. 2, a flowchart of the liquid fuel delivery routine executed by controller 10 for controlling engine 28 is now described. An open loop calculation of desired liquid fuel is first calculated in step 102 by dividing the measurement of inducted mass airflow (MAF) by a desired air fuel ratio (AFd) which, in this particular example, is selected for stoichiometric combustion (14.7 lbs. air per 1 lb. fuel). After a determination is made that closed loop or feedback fuel control is desired (step 104), the open loop fuel calculation is trimmed by fuel feedback variable FFV to generate desired fuel signal Fd during step 106. The operation of controller 10 in generating fuel feedback variable FFV to maintain stoichiometric combustion is described later herein with particular reference to FIG. 3.

Purge compensation signal (PCOMP) is subtracted from desired fuel signal Fd during step 108 to generate modified desired fuel signal Fdm. As described later herein with respect to the routine executed by controller 10 shown in FIG. 4, signal PCOMP represents the mass flow rate of fuel vapors inducted by engine 28 from fuel vapor recovery system 86. After correction by signal PCOMP, the modified desired liquid fuel (Fdm) is converted into fuel pulse width signal fpw for actuating fuel injector 76 (step 110). Accordingly, the liquid fuel delivered by fuel injector 76 is both trimmed by feedback from EGO sensor 44 and reduced in proportion to the mass of inducted fuel vapors to maintain stoichiometric combustion.

Figure 3:
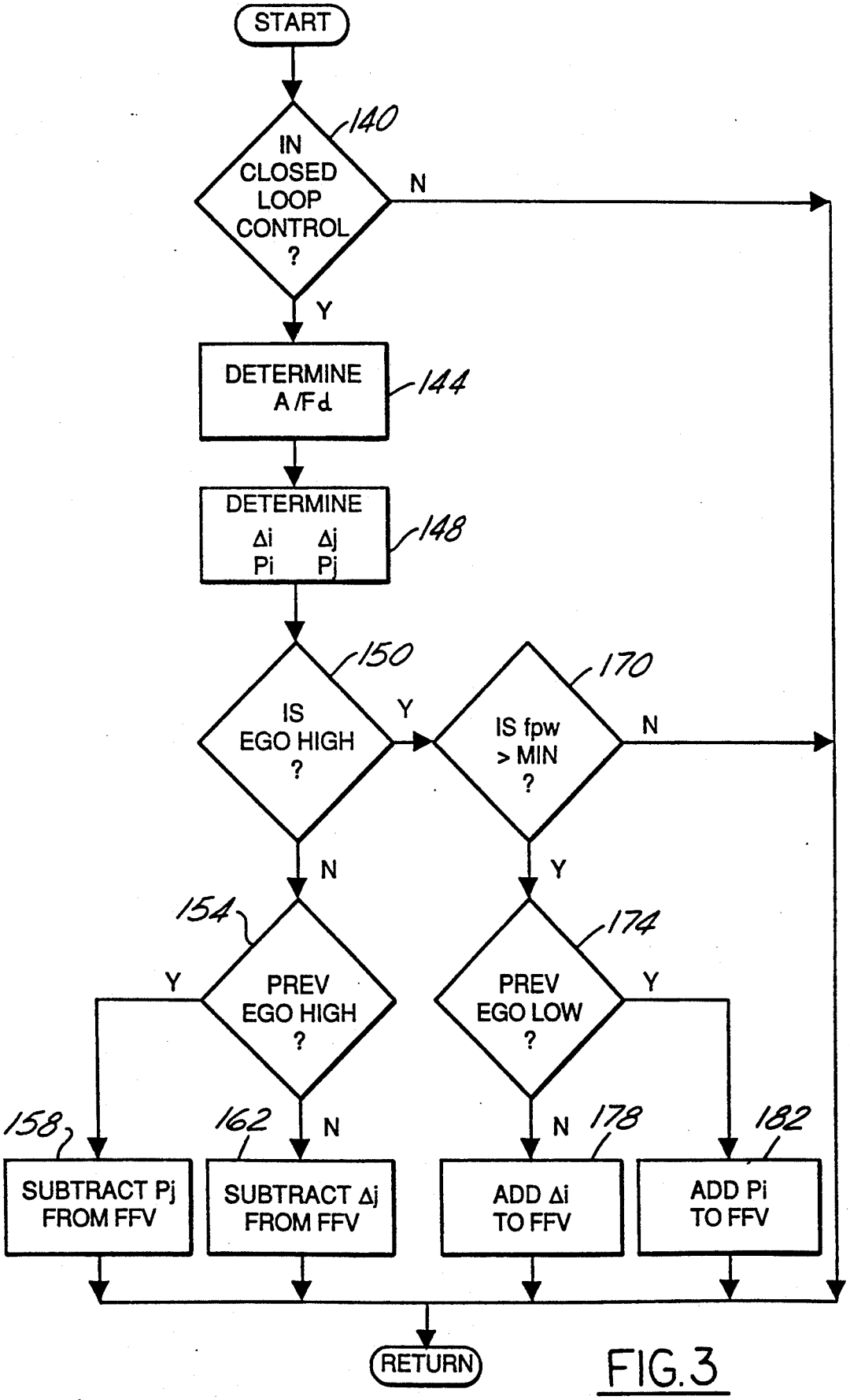

The air/fuel feedback routine executed by controller 10 to generate fuel feedback variable FFV is now described with reference to the flowchart shown in FIG. 3. After a determination is made that closed loop (i.e., feedback) air/fuel control is desired in step 140, the desired air/fuel ratio (AFd) is determined in step 144. The proportional terms (Pi and Pj) and integral terms ($\Delta i$ and $\Delta j$) of the proportional plus integral feedback control system described below are then determined in step 148. These proportional and integral terms are selected to achieve, on average, air/fuel operation at AFd.

EGO sensor 44 is sampled in step 150 during each background loop of controller 10. When EGO sensor 44 is low (i.e., lean), but was high (i.e., rich) during the previous background loop (step 154), proportional term Pj is subtracted from signal FFV in step 158. When EGO sensor 44 is low, and was also low during the previous background loop, integral term $\Delta j$ is subtracted from signal FFV in step 162. Accordingly, in this particular example of operation, proportional term Pj represents a predetermined rich correction which is applied when EGO sensor 26 switches from rich to lean. Integral term $\Delta j$ represents an integration step to provide continuously increasing rich fuel delivery while EGO sensor 26 continues to indicate combustion lean of stoichiometry.

When EGO sensor 44 is high, but was low during the previous background loop (step 174), proportional term Pi is added to signal FFV in step 182. When EGO sensor 44 is high, and was also high during the previous background loop, integral term $\Delta i$ is added to signal FFV in step 178. Proportional terms Pi represents a proportional correction in a direction to decrease fuel delivery when EGO sensor 44 switches from lean to rich, and integral term $\Delta j$ represents an integration step in a fuel decreasing direction while EGO sensor 44 continues to indicate combustion rich of stoichiometry.

Figure 4:
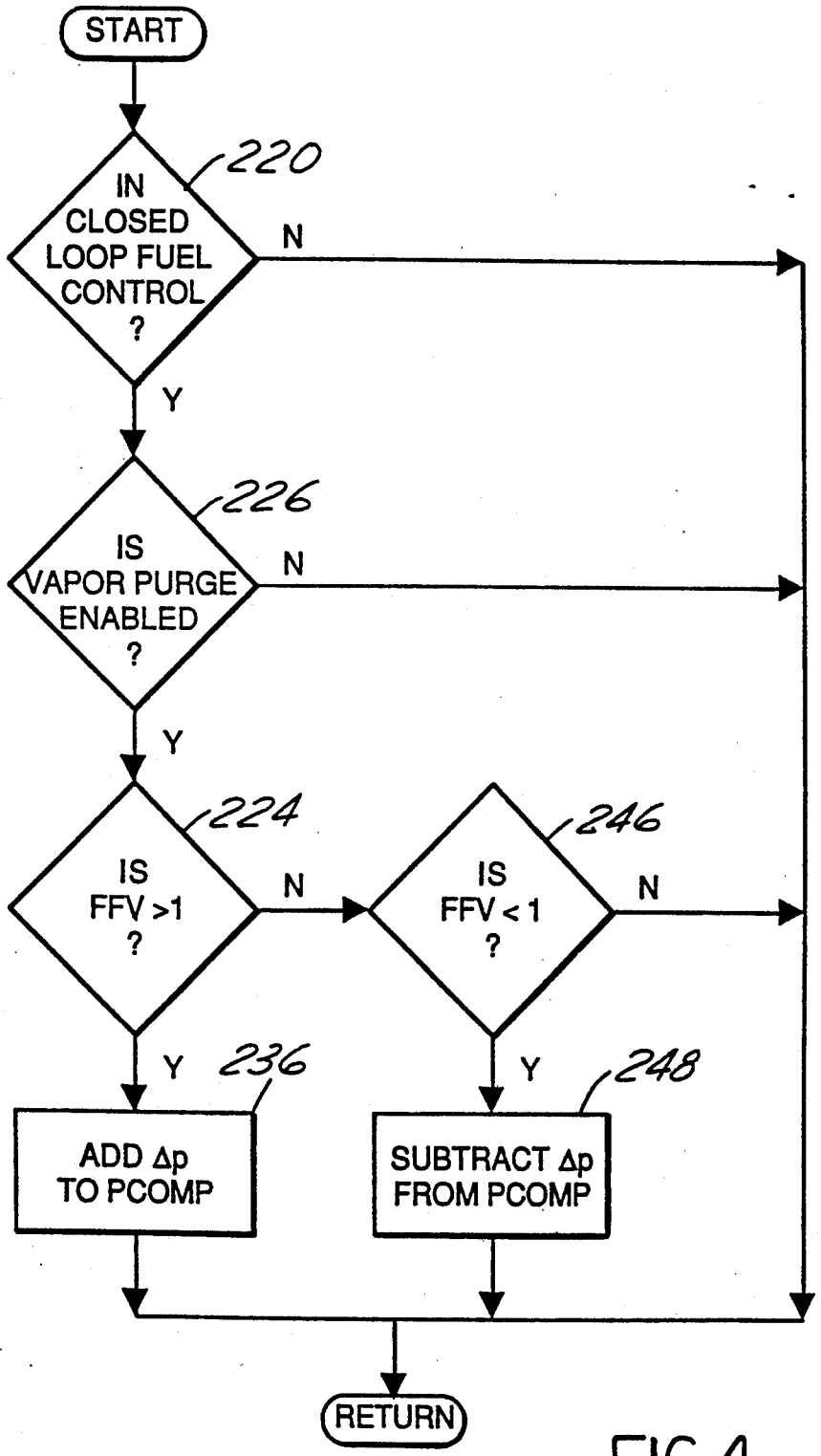

Referring now to FIG. 4, the routine executed by controller 10 to generate purge compensation signal PCOMP is now described. When controller 10 is in closed loop or feedback air/fuel control (step 220), and vapor purge is enabled (step 226), signal FFV is compared to its reference or nominal value, which is unity in this particular example. If signal FFV is greater than unity (step 224), indicating a lean fuel correction is being provided, signal PCOMP is incremented by integration value $\Delta p$ during step 236. The liquid fuel delivered to engine 28 is thereby decreased, or leaned, by $\Delta p$ each sample time when signal FFV is greater than unity. When signal FFV is less than unity (step 246), integral value $\Delta p$ is subtracted from signal PCOMP during step 248. Delivery of liquid fuel is thereby increased and signal FFV is again forced towards unity.

In accordance with the above described operation, the purge compensation routine executed by controller 10 adaptively learns the mass flow rate of recovered fuel vapors. Delivery of liquid fuel is corrected by this learned value (PCOMP) to maintain stoichiometric combustion while fuel vapors are recovered or purged.

Figure 5:
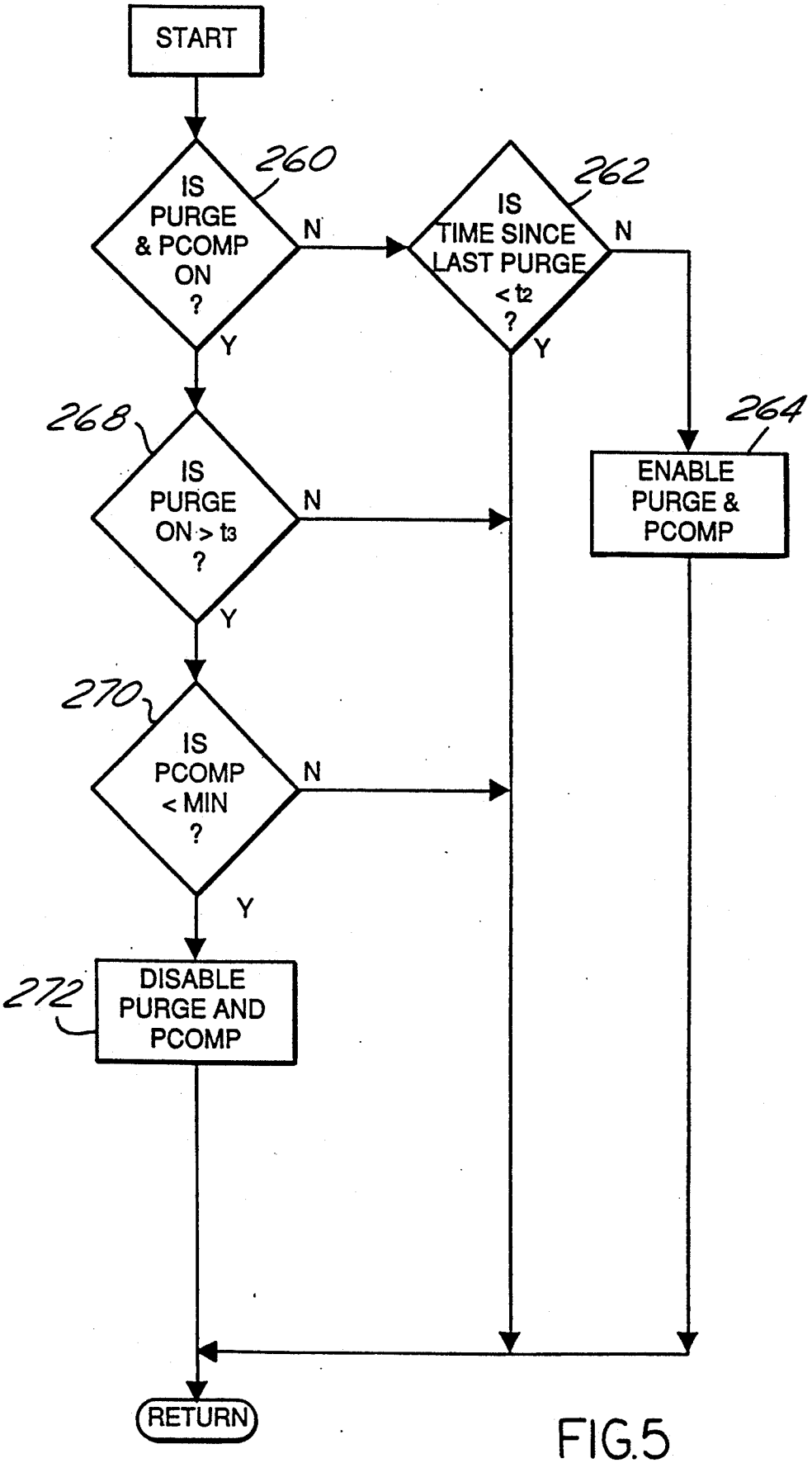

The routine executed by controller 10 for controlling fuel vapor purge and the fuel vapor purge compensation routine is now described with respect to the flowchart shown in FIG. 5. When vapor purge and the purge compensation strategy have been off for more than predetermined time t2 (see steps 260 and 262), fuel vapor purge and the purge compensation strategy are enabled during step 264. On the other hand, if fuel vapor purge and the purge compensation strategy have been activated for greater than predetermined time period t3 (see steps 260 and 268), the value of purge compensation signal PCOMP is compared to a minimum value in step 270. If purge compensation signal PCOMP is less than a minimum value, which corresponds to negligible presence of fuel vapors, then purge duty cycle signal pdc and purge compensation signal PCOMP are reduced to zero (step 272).

In accordance with the operation described above with respect to FIG. 5, fuel vapor purge and the Purge compensation signal are turned off when an indication is provided that negligible fuel vapors exist. When fuel vapor purging has been off for a predetermined time t2, it is turned back on and remains on as long as purge compensation signal PCOMP indicates that more than negligible fuel vapors are present in fuel vapor recovery system 86.

Figure 6:
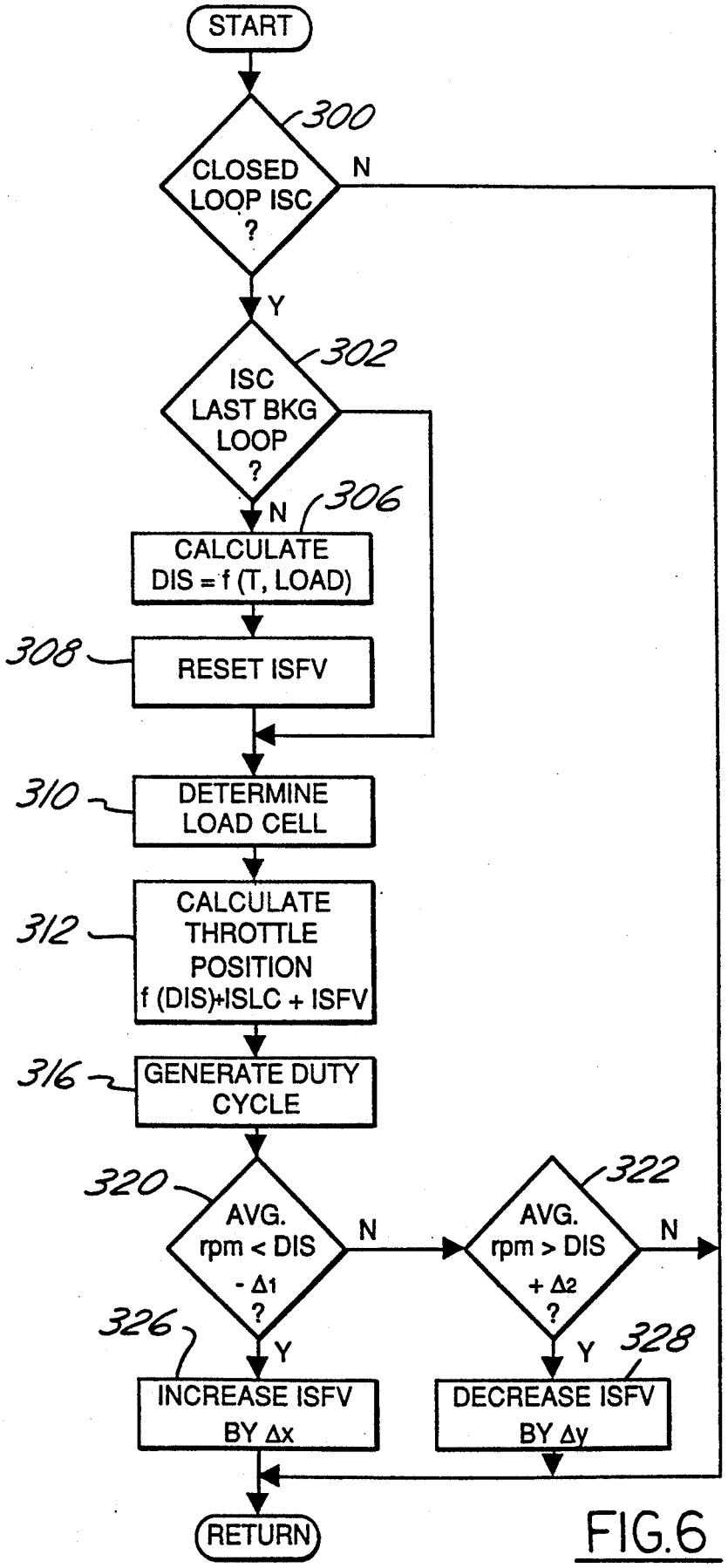

Referring now to FIG. 6, the idle speed feedback control routine performed by controller 10 is now described. Feedback or closed loop idle speed control (ISC) commences when preselected operating conditions are detected (see step 300). Typically such operating conditions are a closed primary throttle position and engine speed less than a preselected value thereby distinguishing closed throttle idle from closed throttle deceleration.

Closed loop idle speed control continues for the time period during which selected engine operating conditions remain at preselected values. At the beginning of each idle speed control period (see step 302), a desired (or reference) idle speed DIS is calculated as a function of engine operating conditions such as engine speed (rpm) and coolant temperature (see step 306). The previous idle speed feedback variable ISFV is also reset to zero (see step 308) at the beginning of each idle speed control period.

After the above described initial conditions are established, the following steps (310–328) are performed each background loop of controller 10. During step 310, the appropriate load operating cell is selected to receive idle speed correction. Controller 10 then calculates desired throttle position for bypass throttling device 66 (step 312). The desired idling speed DIS at the beginning of the idle speed control period is converted into a bypass throttle position, typically by a look-up table, and this initial throttle position is corrected by idle speed learned correction ISLC. As described in greater detail later herein with particular reference to FIG. 7, correction value ISLC was learned during the previous idle speed control period. It is based upon the error between the initial throttle position (derived from DIS) and the actual throttle position which feedback control maintained to operate at the desired idle speed DIS.

Continuing with step 312 shown in FIG. 6, the corrected throttle position (desired or initial position corrected by signal ISLC) is further corrected by the idle speed feedback variable ISFV, the generation of which is described below. The idle speed duty cycle ISDC for operating solenoid valve 72 of bypass throttling device 66 is then calculated in step 316. This duty cycle moves the bypass throttle to the value calculated in step 312.

Controller 10, in this one example of operation, provides a dead band with hysteresis around desired idle speed DIS in steps 320 and 322. When average engine speed is less than the dead band (DIS minus $\Delta 1$), idle speed feedback variable ISFV is increased by predetermined amount $\Delta x$ in step 326. When average engine speed is greater than the dead band (DIS plus $\Delta 2$), ISFV is decreased by predetermined amount $\Delta y$ in step 328. Accordingly, ISFV will appropriately increase or decrease the bypass throttle position (see step 312) to maintain, on average, desired idle speed DIS.

Figure 7:
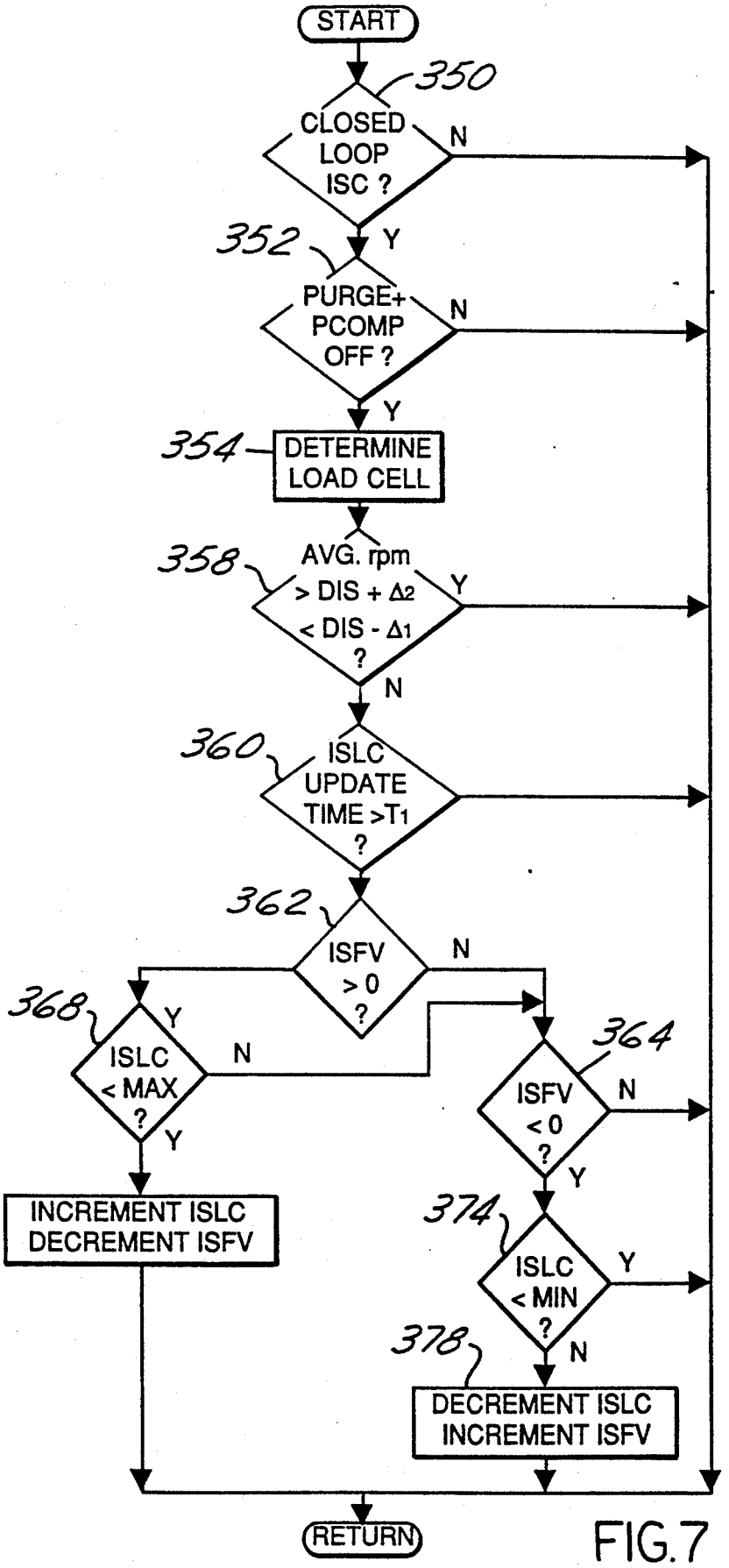

Referring now to FIG. 7, the routine executed by controller 10 is described for learning the error between initial bypass throttle position and the actual throttle position which maintains desired idle speed DIS. After the previously referenced engine operating parameters initiate closed loop idle speed control ISC in step 350, a determination is made in step 352 of whether vapor purge and purge compensation operation are actuated. As previously described with reference to the example of operation presented in FIGS. 4 and 5, vapor purge compensation is deactuated when the quantity of purged vapors falls below a minimum value (PCOMP<Min). The learning proceeds after vapor purge and purge compensation are deactuated.

During step 354, the engine operating load cell is determined for application of idle speed learned correction ISLC. Average engine rpm is then checked for operation within a permissible band in step 358. After verification that preselected time T1 has elapsed since generation of the previous ISLC, the presence of a positive or negative idle speed feedback variable ISFV is checked in respective steps 362 and 364. When ISFV is greater than zero (i.e., bypass throttle position is too small to maintain DIS) and ISLC is less than its maximum (step 368), ISLC is incremented a predetermined amount (step 370). Concurrently, ISFV is decremented the same predetermined amount.

Similarly, when ISFV is negative (i.e., bypass throttle position greater than needed to maintain DIS) and ISLC is greater than its minimum (step 374), ISLC is decremented a preselected amount (step 378). Concurrently, ISFV is incremented the same preselected amount.

Accordingly, idle speed learned correction ISLC learns the error in bypass throttle position from the position needed to maintain desired idle speed DIS by driving idle speed feedback variable ISFV to zero. This learning is inhibited when vapor purge compensation (PCOMP>Min) is active thereby avoiding the previously described problems recognized by the inventor herein.

Although one example of an embodiment which practices the invention has been described herein, there are numerous other examples which could also be described. For example, analog devices, or discrete IC's may be used to advantage rather than a microcomputer. The invention is therefore to be defined only in accordance with the following claims.

What is claimed is:

1. A method for controlling engine idle speed of a motor vehicle having a fuel vapor recovery system coupled to the engine air intake through a control valve, comprising the steps of:

initiating idle speed control during each period when engine operating parameters are in a predetermined state;

calculating a desired engine speed upon said initiation of said idle speed control period;

generating an initial throttle position for a bypass throttling device based upon said desired engine speed;

correcting said initial throttle position upon said initiation of said idle speed control period by a correction factor calculated during a previous idle speed control period;

updating said correction factor during current idle speed control operation for application during a subsequent idle speed control period by learning average difference between said desired engine speed and actual engine speed; and inhibiting said learning during actuation of the fuel vapor recovery valve.

2. The control method recited in claim 1 further comprising the step of maintaining said actual engine speed at said desired engine speed during said current idle speed control operation by adjusting said corrected initial throttle position in response to comparisons of said desired engine speed with said actual engine speed.

3. The control method recited in claim 1 further comprising the steps of calculating flow rate of inducted fuel vapors in response to an exhaust gas oxygen sensor and deactuating said fuel vapor recovery valve when said calculated quantity is less than a predetermined value.

4. A method for controlling engine idle speed of a motor vehicle having a fuel vapor recovery system coupled to the engine air intake through a control valve, comprising the steps of:

initiating idle speed control during each period when engine operating parameters remain in a predetermined state;

calculating a desired engine speed upon said initiation of said idle speed control period;

generating an initial throttle position for a throttling device bypassing a primary engine throttle valve, said initial bypass throttle position being based upon said desired engine speed;

correcting said initial bypass throttle position upon said initiation of said idle speed control period by a correction factor calculated by comparing said desired engine speed to actual engine speed during a previous idle speed control period; and learning a new correction factor during current idle speed control operation for application during a subsequent idle speed control period, said learning being enabled in response to an indication that quantity of recovered fuel vapors inducted into the engine is less than a preselected value.

5. The method recited in claim 4 wherein said idle speed control initiating step is responsive to an indication of said primary engine throttle being substantially closed.

6. The method recited in claim 4 further comprising a step of maintaining said actual engine speed at said desired engine speed during said current idle speed control operation by continuously adjusting said bypass throttle in response to a feedback variable derived from a comparison of said desired engine speed to said actual engine speed.

7. An idle speed control system for a motor vehicle having a fuel vapor recovery system coupled to an engine air intake through a control valve, comprising:

an idle speed controller for controlling a bypass throttle coupled to the engine air intake in response to a feedback variable and an initial throttle position signal and an initial throttle position correction signal;

feedback means for generating said feedback variable by integrating a difference between said desired engine speed and said actual engine speed;

positioning means for converting said desired engine speed into said initial throttle position signal; and learning means for generating said initial throttle position correction signal by integrating said feedback variable and concurrently driving said feedback variable towards zero to learn an average difference between said initial throttle position and actual throttle position maintained by said idle speed controller, said learning means being enabled when an indication is provided that quantity of recovered fuel vapors inducted into the engine is less than a preselected value.

8. The idle speed control system recited in claim 7 further comprising commencement means for commencing idle speed control during each period when engine operating parameters are in a predetermined state and wherein positioning means generates said initial throttle position upon said commencement of each of said idle speed control periods.

9. The idle speed control system recited in claim 8 wherein said feedback means resets said feedback variable upon said commencement of each of said idle speed control periods.

10. The idle speed control system recited in claim 7 wherein said feedback means and said positioning means and said learning means generate said respective feedback variable and said initial throttle position and said initial throttle position correction signal for each of a plurality of engine load operating conditions.

11. The idle speed control system recited in claim 7 wherein said indication of said recovered fuel vapors being less than a preselected value is provided by integrating a difference between an integral of an exhaust gas oxygen sensor from unity.

* * * * *